US005354960A

United States Patent [19]

Erickson

[11] Patent Number: 5,354,960

[45] Date of Patent: Oct. 11, 1994

[54] LINEAR MOTOR POWERED SHUNT TRIP OPERATOR

[75] Inventor: William C. Erickson, Cary, Ill.

[73] Assignee: Boltswitch, Inc., Crystal lake, Ill.

[21] Appl. No.: 72,339

[22] Filed: Jun. 4, 1993

[51] Int. Cl.[5] ..... H01H 5/00

[52] U.S. Cl. ..... 200/400

[58] Field of Search ..... 200/400

[56] References Cited

U.S. PATENT DOCUMENTS 3,359,464 12/1967 Henderson .
3,911,240 10/1975 Henderson et al. .
4,020,432 4/1977 Erickson et al. .
4,110,584 8/1978 Erickson et al. .

*Primary Examiner*—Renee S. Luebke
*Attorney, Agent, or Firm*—Dorn, McEachran, Jambor & Keating

[57] ABSTRACT

A linear actuator powered closing mechanism for a trip-free operating mechanism of a high current, low voltage, load break switch of the type having an operating shaft and a follower affixed to the operating shaft for rotation therewith. A lever is mounted on the operating shaft for rotation therewith. A spring connects the follower and the operating lever to bias them toward each other when the spring is energized. The closing assembly includes a linear actuator having an extendible and retractable tube. A drive rod is connected to the operating shaft to rotate the operating shaft in a spring energizing direction upon longitudinal movement of the drive rod in one direction. A mechanism connecting the actuator tube and the drive rod so that movement of the actuator tube in one direction will move the drive rod in its spring energizing direction while movement of the actuator tube in the opposite direction will not result in opposite movement of the drive rod.

6 Claims, 7 Drawing Sheets

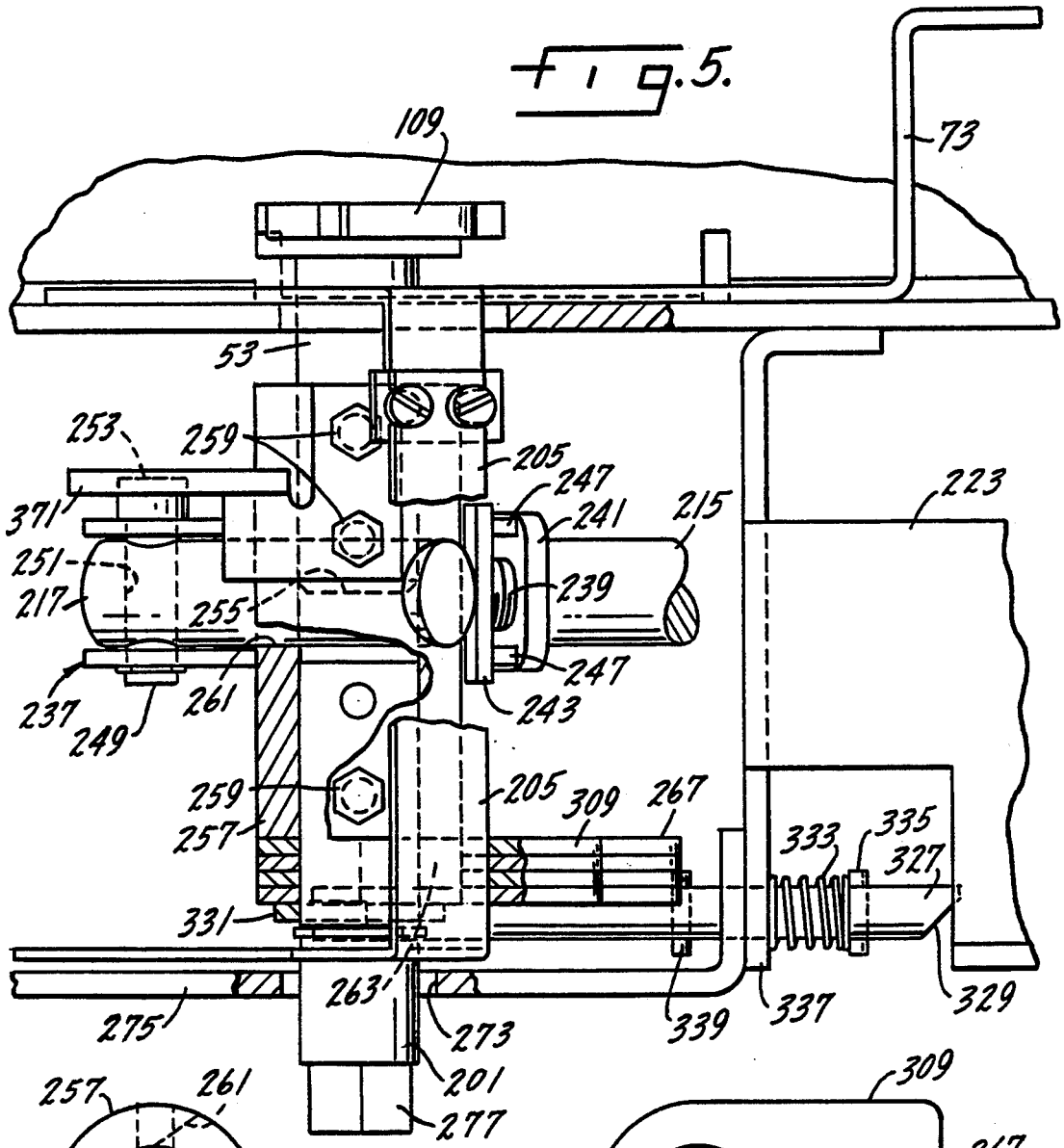
Fig. 5.
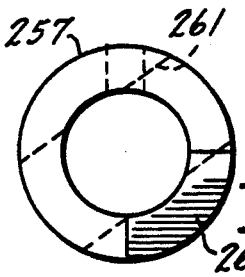
Fig. 6.
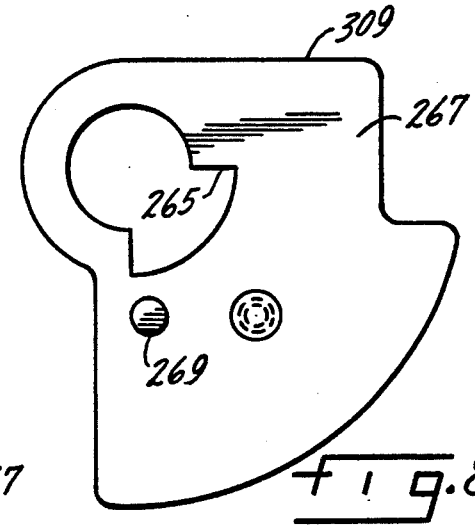
Fig. 8.
Fig. 7.
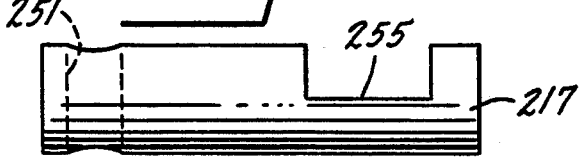

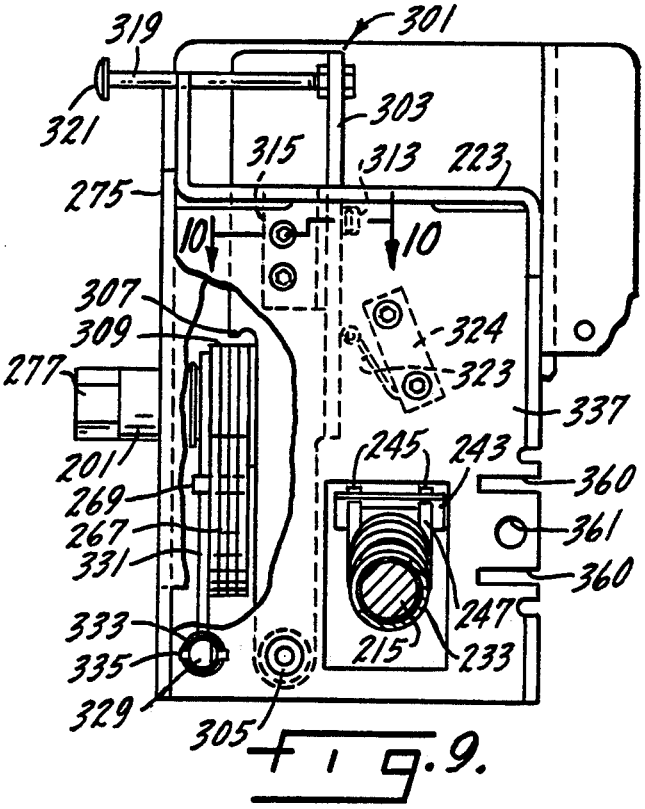
Fig. 9.
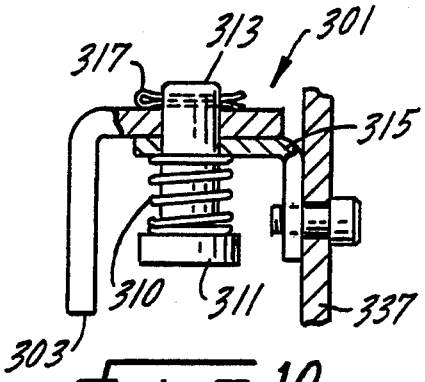
Fig. 10.
Fig. 11.
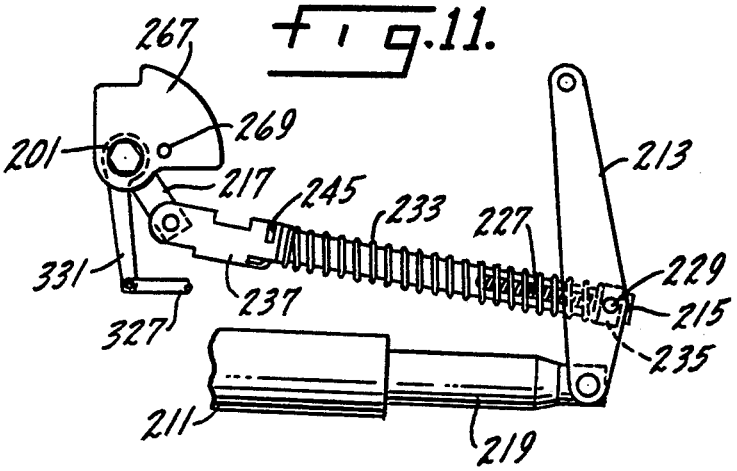
Fig. 12.
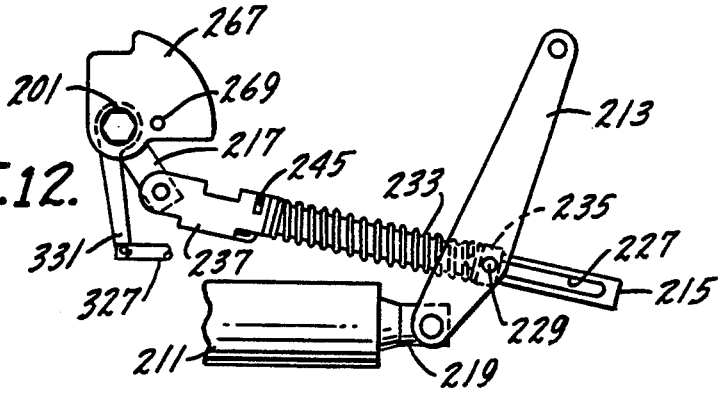

LINEAR MOTOR POWERED SHUNT TRIP OPERATOR

BACKGROUND OF THE INVENTION

This invention relates to a linear motor powered remotely controlled shunt trip operator for a bolted pressure contact swatch that utilizes the positive linear displacement of a rod of a linear motor to rotate the operating shaft of the shunt trip operator in its closing direction.

A shunt trip switch operator mechanism for a bolted pressure contact switch includes an operating shaft which is latched in the closed condition of the switch contacts against rotation which is urged by the bias of one or more energized springs. Release of the operating shaft latch by a solenoid or a manually actuated mechanism allows the operating shaft to rotate under the bias of the energized springs to an angular position which defines the open condition of the bolted pressure switch contacts.

The operating shaft of the shunt trip operator is also arranged so that it may be rotated manually or by a powered drive mechanism to the closed position of the bolted pressure switch contacts. Closing rotation of the operating shaft usually also energizes both opening and closing springs so that a considerable force must be exerted under these circumstances to rotate the operating shaft. In previous shunt trip operators, the rotation of the operating shaft to close the bolted pressure switch contacts has been accomplished by an electrical motor which was connected by ratchet mechanisms and links to the operating shaft. This previous type of motorized shunt trip operator was expensive to build and somewhat difficult to adjust and maintain. Its installation on a bolted pressure contact switch limited access to one of the fuses.

SUMMARY OF THE INVENTION

It is an object of the present invention, therefore, to provide a remotely controlled shunt trip operator that uses an electrically energized linear motor with a simplified motor and translation linkage mechanism to energize the closing springs of the shunt trip operator which in turn moves the switch contacts to their closed positions.

Another object of this invention is a linear motor powered shunt trip operator having a linear actuator which is energized only when rotating the operating shaft to the closed position of the switch contacts and which is returned to its original deenergized condition immediately.

Another object of this invention is a linear motor powered shunt trip operator which can be installed on a bolted pressure contact switch without limiting access to any of the fuses.

Accordingly, the invention relates to a linear motor powered closing assembly for a shunt trip operating mechanism of a high current, low voltage, load break switch of the type having an operating shaft, a follower affixed to the operating shaft for rotation therewith, an operating lever mounted on the operating shaft for rotation relative thereto and a spring means connecting the follower and the operating lever to bias them towards each other when the spring means is engaged. The linear motor powered closing assembly includes a linear actuator having an extendible and retractable tube. A drive rod is connected to the operating shaft to rotate the operating shaft in a spring means energizing direction upon longitudinal movement of the drive rod in one direction. Means are provided to connect the actuator tube and the drive rod so that the movement of the actuator tube in one direction will move the drive rod in its spring means energizing direction while movement of the actuator tube in the opposite direction will override the drive rod so that the actuator tube can be returned to its original condition without reverse movement of the drive rod to maintain the switch contacts in their closed positions. When the actuator tube overrides the drive rod, it also compresses a coil spring encircling the drive rod which helps bias the operating shaft to the switch contacts open position.

BRIEF DESCRIPTION OF THE DRAWINGS

FIG. 5 is an enlarged, partial, top plan view of the linear motor powered operating mechanism of FIG. 4 with some parts broken away, some parts omitted, and others shown in cross section for clarity of illustration;

FIG. 6 is an end elevation view of a portion of the extension of the main operating shaft of the shunt trip operator;

FIG. 7 is a side elevational view of an arm shown in FIG. 5;

FIG. 8 is a front elevational view of the counterweight shown assembled in FIG. 5;

FIG. 9 is a partial, end elevational view of the linear motor powered operating mechanism shown in FIG. 3 of the drawings;

FIG. 10 is an enlarged view taken along line 10—10 of FIG. 9;

FIG. 11 is a schematic representation of the linear motor powered shunt trip operator mechanism showing an intermittent position of movement of the actuator tube during closing of the switch contacts;

FIG. 12 is a schematic representation similar to that of FIG. 11 but showing the final position of the linear actuator when the switch contacts are closed.

DESCRIPTION OF THE PREFERRED EMBODIMENT

Figure 1:
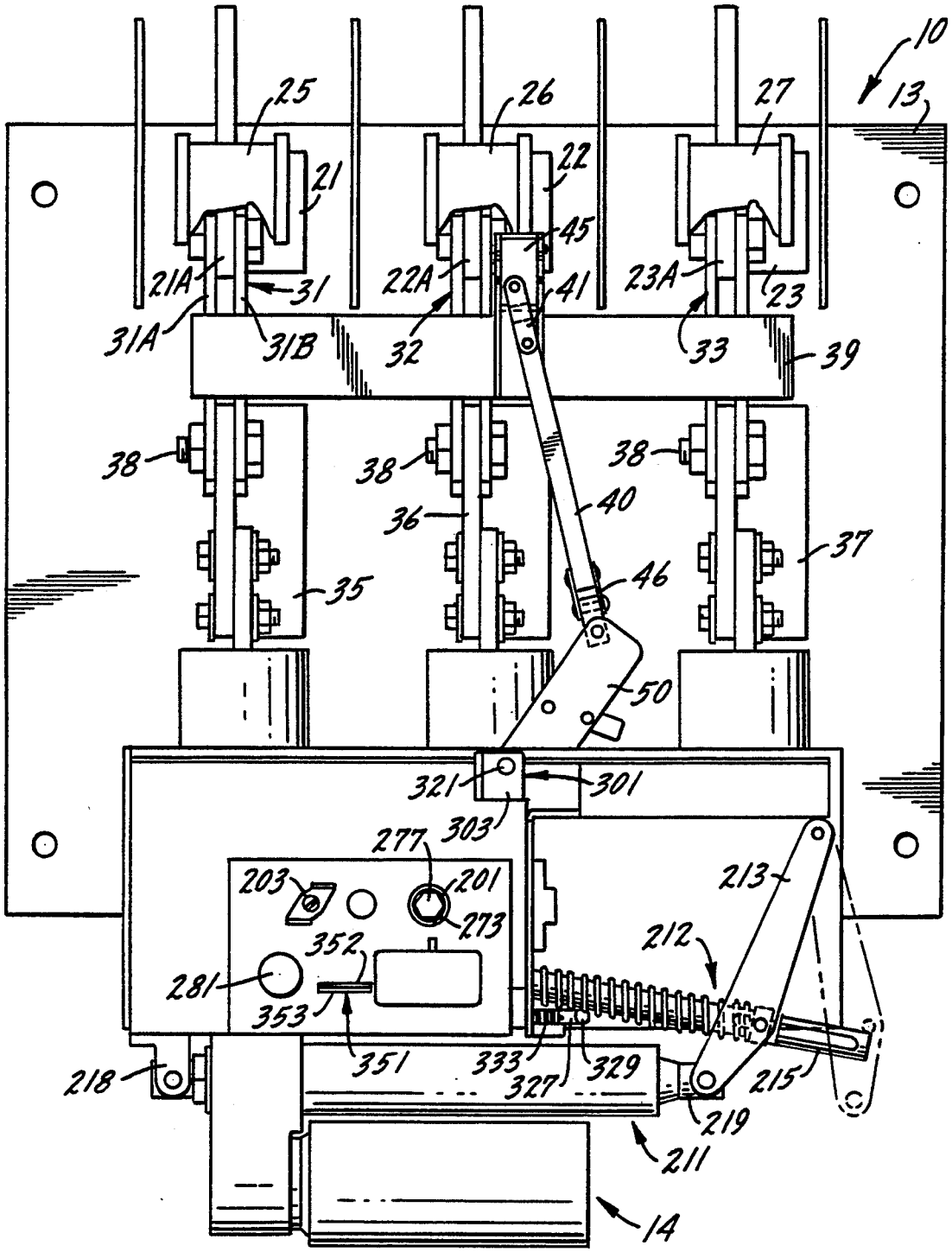
FIG. 1 is a front elevational view of a load-break switch equipped with a linear motor powered shunt trip operator mechanism constructed in accordance with the present invention, the switch itself being of a known construction, shown in the closed condition of the switch contacts, with an intermediate position shown in phantom lines.
Figure 2:
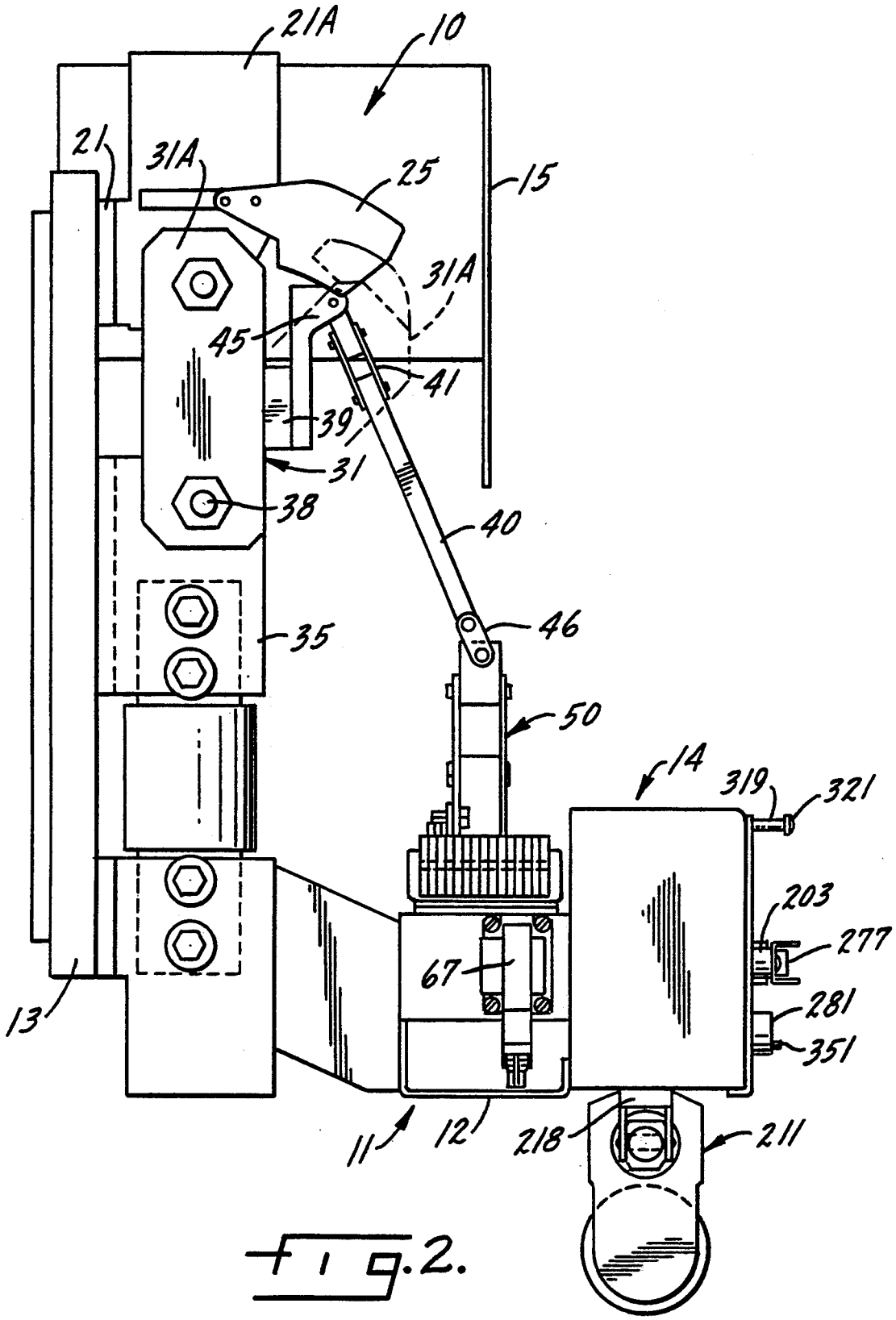
FIG. 2 is a side elevational view of the switch of FIG. 1.

FIGS. 1 and 2 illustrate a load break pressure contact switch 10, having a contact mechanism of known construction, shown in its closed condition. Switch 10 is operated by a trip-free operating mechanism 11 mounted in a housing 12 supported on a base 13. The trip-free operating mechanism 11 is operated by the linear motor powered closing mechanism 14 of the present invention. A transparent shield 15, shown in FIG. 2 extends across the front of the switch contacts.

Switch 10 includes the previously mentioned base member 13 which is fabricated from a suitable insulating material. Across the top of the base 13 there are mounted three fixed contacts 21, 22 and 23. The fixed contacts 21, 22 and 23 are provided with outwardly projecting contact blades 21A, 22A, 23A, respectively and each may be provided with an individual terminal lug (not shown) thus affording three input terminals for each switch 10. Three arc chutes 25, 26 and 27 are mounted on the fixed contacts 21, 22, and 23, respectively.

Each of the fixed contacts 21, 22 and 23 is one element of a pole for the switch 10. Fixed contacts 21, 22 and 23 are engageable by three movable contacts 31, 32 and 33, respectively. Each of the movable contacts of the switch comprises a pair of contact blades such as blades 31A and 32B for movable contact 31. Movable contacts 31, 32 and 33 are pivotally mounted upon three electrical connector brackets 35, 36 and 37, respectively, by means of suitable pivot members such as bolts 38.

Switch 10 further includes an actuating bar 39 which extends transversely of the switch and is also pivotally mounted upon the three fixed contact brackets 35, 36 and 37 by means of the three bolts 38. An actuator bar is connected to each of the movable contacts 31, 32 and 33 by means of a connecting linkage, so that pivotal movement of the bar 39 with respect to the aligned pivot members 38 drives the movable contacts of the switch to move pivotally in and out of engagement with the fixed contacts 21, 22 and 23. Switch 10 is also provided with appropriate overload fuses and electrical connectors to afford a means to connect electrical connections to the movable contacts.

Switch 10, as thus far described, corresponds in construction to the load break pressure switch described and claimed in U.S. Pat. No. 3,213,247. The present invention is not directed to the switch structure per se, but pertains to the linear motor powered closing mechanism 14 for the shunt trip operating mechanism 11 that is incorporated in the switch 10 and that is utilized to open and close the switch. The invention should not be construed as limited to the particular load break switch of U.S. Pat. No. 3,213,247, which is merely illustrative of a number of different forms of switch with which the invention may be used. Nor should the invention be limited to the trip-free operating mechanism 11 described herein.

The actuating bar 39 of the switch 10 is connected to an operating rod 40 by means of a pivotal connection 41. More specifically, the rod 40 has its upper end affixed to an upper yoke 45 and its lower end secured to a lower yoke 46. Lower yoke 46 is pivotally connected to an operating lever 50 that is part of the operating mechanism 11. In FIGS. 1 and 2, operating lever 50 is shown in its upper or closed switch contact position. When switch 10 is tripped to its open switch contacts position, the lever 50, which turns in a clockwise direction as viewed in FIG. 1 of the drawings, pulls drive rod 40 downwardly to pivot the actuating bar outwardly and away from the switch face 13. This pivotal movement of the bar 39 simultaneously pivots the movable contacts 31, 32 and 33 outwardly from the fixed contacts 21, 22 and 23 to the open position 31A shown in FIG. 2 and thus opens the switch. It should be noted that the angular extent of the arcuate movement of bar 39 does not necessarily correspond to the arcuate movement of the switch contacts; in a typical instance, bar 39 may move through an arc of approximately 90° whereas the blade contacts of the switch are pivoted only through an angle of approximately 45° . However, this differential is not critical to the operation of the present invention and is a matter of design choice insofar as the construction of the switch contacts is concerned.

The number of poles in the switch 10 as well as the size of the switch, may be varied for different applications. However, for all switches of this general kind it is essential that the contact separate rapidly and close rapidly in order to prevent excessive arcing, which would otherwise limit the useful life of the contacts quite severely.

The construction and operation of the switch operating mechanism 11 is essentially the same as that shown and described for the mechanism 11 in U.S. patent application Ser. No. 07/749,680, filed Aug. 26, 1991, now U.S. Pat. No. 5,276,228, issued Jan. 4, 1994, and owned by the assignee of this patent application. This application is incorporated herein by reference. The mechanism 11 includes an operating lever 50, a main drive shaft 53, a follower 55 which is mounted on the shaft 53, a spiral-shaped closing spring 57, a coil shaped opening spring 59, a switch closing latch 61, a switch open latch 63, a trip lever 65 for the switch closing latch, a trip solenoid also for the switch closing latch, an operating handle latch 71 and a target. The shaft 53, trip lever 65, and the target have been modified essentially by the provisions of extensions 201, 203 and 205, respectively, to adapt these parts to connect to the linear motor powered actuator closing mechanism 14.

When the switch contacts 31, 32 and 33 are in their closed positions as shown in FIGS. 1 and 2, the contacts may be moved to their open positions to disconnect the electrical circuits by the operation of manual or electrical mechanisms. For example, rotation of the extension shaft 203 will operate the trip lever 65 which trips the switch closing latch 61 and releases the operating lever follower 55 so that the residual tension in the spiral closing spring 57 will rotate the operating lever 50. The switch closing latch 61 may also be released by actuation of the solenoid.

Figure 3:
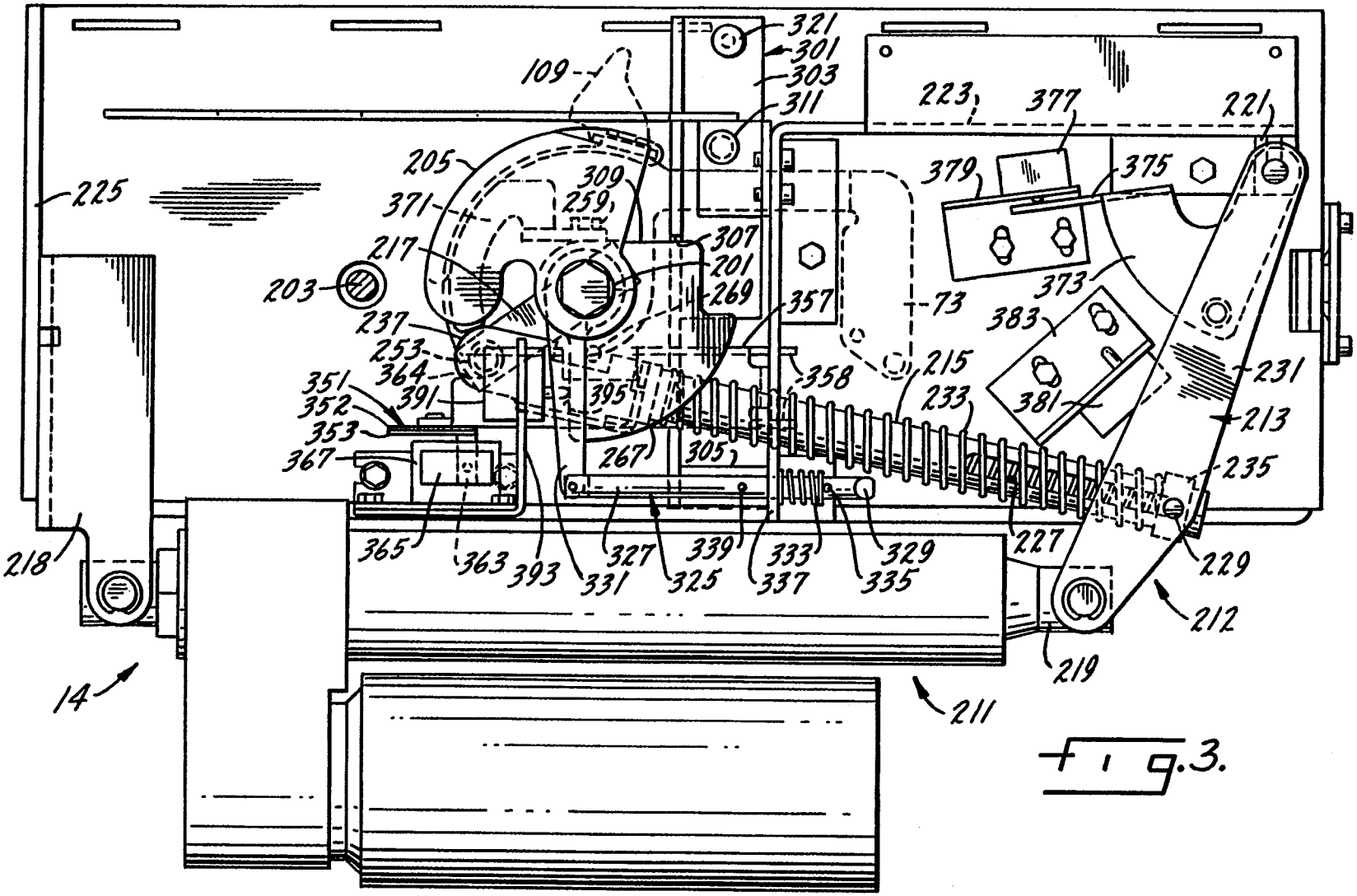
FIG. 3 is an enlarged, front elevational view, with the front wall of the housing removed, of the linear motor powered operated device for the shunt trip operating mechanism of the switch of FIG. 1, as seen when the switch contacts are in their open positions, with some hidden parts shown in dashed lines.

During opening of the switch contacts, the shaft 53 is rotated in a clockwise direction as viewed in FIGS. 1 and 3 of the drawings. To close the switch contacts, the shaft 53 must be rotated in a counterclockwise direction as viewed in FIGS. 1 and 3. In previous trip-free operating mechanisms, the shaft 53 was rotated in its closing direction by physical manipulation of an operating handle or as shown in Erickson et al U.S. Pat. No. 4,020,432 by an electric motor through a series of transmissions, one of which included a mutilated ratchet mechanism.

The linear motor power actuated closing mechanism 14 of this invention uses a linear actuator 211 to rotate the shaft 53 in its switch contact closing direction of rotation, i.e., counterclockwise as viewed in FIGS. 1 and 3. While linear motors such as a hydraulic or pneumatic cylinders may be used, it is desirable to use what is called a linear actuator. A suitable linear actuator is sold by Warner Electric of South Beloit, Ill. under the trademark ELECTRAK linear actuator systems.

The linear actuator 211 is operatively connected to the shaft 53 through a translation mechanism 212 which includes a pivotally mounted clevis-like lever 213, a drive rod 215 and a stub arm 217. The linear actuator 211 is pivotally mounted at one end to a clevis-like bracket 218. An extendible and retractable rod 219 extends out of the other end of the linear actuator and this rod is pivotally connected to the free end of the lever 213. The opposite end of the lever 213 is pivotally connected to a bracket 221 depending from a top wall 223 of the linear motor powered closing mechanism housing 225. The drive rod 215 is pivotally connected by a one-way drive to the lever 213 at a location intermediate the ends of the lever. This pivotal one-way connection is accomplished by the provision of a longitudinally extending slot 227 formed in the drive rod 215 and a pin 229 which rides in the slot 227 and is attached at its opposite ends to spaced apart bars 231 which form the clevis-like lever 213. A coiled compression spring 233 surrounds the drive rod 215 and bears against a collar 235 through which the pin 229 extends. A clevis 237 connects an end of the drive rod 215 to the stub arm 217. The clevis 237 is connected to the drive rod 215 by a headed screw 239 which is threaded through an end wall 241 of the clevis and threads into the drive rod. A stop plate 243 fits into slots 245 formed in opposite side walls 247 of the clevis in contact with the head (not shown) of the headed screw 239 to provide for tightening adjustment of the screw 239. The opposite end of the clevis 237 is pivotally connected to the stub arm 217 by a pivot pin 249 as shown in FIG. 5 of the drawings. The pivot pin 249 extends through the walls 247 of clevis 237 and through a passage 251 in an end of the stub arm 217. A head 253 is formed on one end of the pivot pin 249.

The operational connection between the shaft 53 and the stub arm 217 is achieved by the seating of the end of the shaft 53 in a cutout 255 formed in the stub arm 217 as shown in FIGS. 5 and 7. A sleeve 257 surrounds the shaft 53, stub arm 217 and shaft extension 201 and is attached to the shaft and shaft extension by headed threaded fasteners 259. As shown most clearly in FIGS. 5 and 6, the sleeve 257 is formed with a diametrically extending passage 261 through which stub arm 217 extends. An arcuate key 263 extends longitudinally from the outer end of the sleeve to seat in a wedge-shape cutout 265 in a laminated counterweight 267 as shown in FIG. 8. The counterweight 267 is mounted on the shaft extension 201 in the manner shown in FIG. 5. A pin 269 extends outwardly from the front face of the counterweight. The shaft extension 201 extends through an opening 273 formed in the front wall 275 of the housing 225. The shaft extension terminates in a head 277 of hexagonal cross section which is adapted to receive a wrench or handle for rotating the shaft 53.

The principal function of the linear motor powered actuated closing mechanism 14 of this invention is to permit the closing of the switch contacts without requiring physical manipulation of the shaft 53. This can be accomplished by the closing of the switch 279 shown in FIG. 13 which is brought about by pushing the close button 281 located on the front of the enclosure 225 shown in FIG. 1 or by actuating the remote close switch 283 shown in FIG. 13. Closing of either switch 279 or 283 will actuate solid state relay 287, which in turn will actuate solid state relays 289 and 295 to release the internal brake of the linear actuator 211 and extend the tube 219 thereof from its position shown in FIG. 3 to its position shown in FIG. 11 of the drawings. Extension of the tube 219 will rotate the pivotally mounted lever 213 in a counterclockwise direction as viewed in FIG. 11 to move the drive rod 215 longitudinally to the right as viewed in FIG. 11. Longitudinal movement of the drive rod 215 to the right will rotate the stub arm 217 in a counterclockwise direction from its position shown in FIG. 3 to its position shown in FIG. 11. The shaft extension 201 and shaft 53 will be rotated in a counterclockwise direction as viewed in the drawings to rotate the follower 50 of the shunt trip mechanism 11 to its switch contacts closing position.

After the tube 219 has reached its fully extended position as shown in FIG. 11, the solid state relay 285 is actuated. Actuation of relay 285 will energize relays 291 and 389 to release the internal brake of the linear actuator and to cause the tube to retract to the position shown in FIG. 12. The tube 219 may be retracted by the linear actuator 211 without forcing the stub arm 217 to rotate in a clockwise direction as viewed in FIGS. 11 and 12 because of the one-way connection between the lever 213 and the drive rod 215. This one-way connection includes the pin 229 which extends through the collar 235 and rides in the slot 227 of the drive rod 215. As the lever 213 rotates in a clockwise direction under the pulling force of the retracting tube 219, the pin 215 carries the collar 235 to compress the spring 233 against the clevis 237. The compressed spring 233 and the elevated counterweight 267 will assist in rotating the stub arm 217 in a clockwise direction as viewed in FIGS. 11 and 12 when the shunt trip operator 11 is actuated to open the switch contacts.

There are a number of mechanical and electrical safety interlocks installed in the linear motor powered closing mechanism 14 remotely controlled shunt trip operator 11 of this invention. An interlock 301, most clearly shown in FIGS. 3, 4, 9 and 10, prevents rotation of the operating shaft 53 from its switch contacts open position of FIG. 3 to its switch contacts close position shown in FIGS. 1 and 12 when the door on the housing (not shown) which encloses the linear powered closing mechanism 14 is open. This interlock includes an upstanding angle bar 303 which is pivotally mounted at its bottom on a horizontally extending pivot pin 305 for rotation towards and away from the front of the housing enclosing the shunt trip operator. A lower portion of one of the walls of the angle bar 303 is cut away to form a downwardly facing tooth 307 which engages an edge 309 formed on the counterweight 267 as shown in FIG. 9. The angle bar 303 is biased to this counterweight engagement position by a spring 310, shown in FIG. 10, which is trapped between the head 311 of a pin 313 and a bracket 315 through which the pin extends. The pin 313 also extends through the angle bar 303 and is secured thereto by a cotter pin 317. A push rod 319 for releasing the tooth 307 from engagement with the edge 309 of the counterweight 267 extends beyond the front of the shunt trip operator where its head 321 can be engaged by a door of the housing (not shown) when the door is closed. Closing of the door will force the rod 319 to tilt the angle iron 303 to the right as viewed in FIG. 9 to release the tooth 307 from engagement with the edge 309 of the counterweight 267. Tilting of the angle bar 303 will move the pivoting lever 323 of the switch 324 to close the switch.

A latching mechanism 325 is provided for the linear motor powered shunt trip operator mechanism 14 compartment housing door (which door is not shown). This latching mechanism which is shown in FIGS. 3, 4, 5, 9, 11 and 12 prevents opening of the door to the compartment when the switch contacts are closed. The latching mechanism includes a bolt 327 having a tapered end 329 which is engaged by the closing of the door of the housing. The opposite end of the bolt 327 is pivotally connected to the lower end of an arm 331 which freely swings about the shaft extension 201. A coil spring 333 telescopes over the bolt 327 and is trapped between a pin 335 extending out of the bolt and a partition 337 to bias the bolt to its door latching position to the right as viewed in FIG. 3. Movement of the bolt 327 to its latching position is prevented by engagement of the stop pin 269 on the counterweight 267 with the arm 331. When the counterweight is in its switch contacts closed position as shown in FIGS. 11 and 12, the pin 269 will be rotated counterclockwise to a position clear of the arm 331 so that the spring 333 will move the bolt 327 to the right as viewed in FIG. 3. A second pin 339 extending out of the bolt 327 engages the partition 337 to limit movement of the bolt 327 to the right as viewed in FIG. 3.

Figure 4:
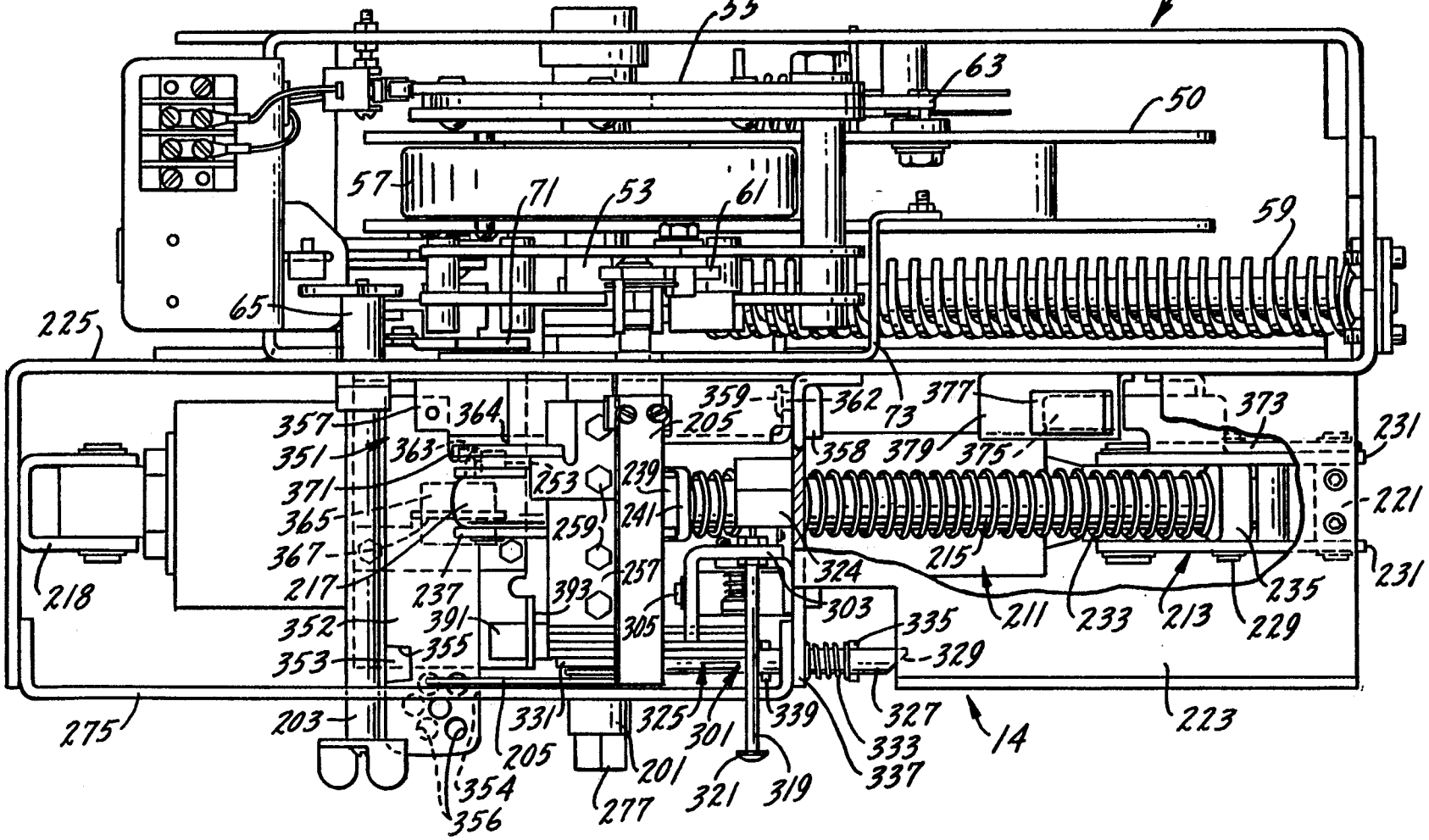
FIG. 4 is a top plan view of the linear motor powered operating mechanism and the shunt trip operator of FIG. 3 with some parts omitted and others broken away for clarity of observation.

A padlock secured lockout 351 for use by electricians and other workers is shown in FIGS. 1, 2, 3 and 4. The padlock lockout includes superimposed flat plates 352 and 353 which are supported to slide in and out of the front wall 275 of the housing through a slot 354 having a height equal to the thickness of the plates and a width equal to the width of a plate. The upper plate 352 has a notch 355 formed in one edge thereof. Holes 356 are formed in each plate to receive a padlock. When the plates 352 and 353 are pulled out through the slot 354 in the front wall 275 of the housing, the top plate 352 can be rotated in a clockwise direction so that the notch engages the front wall of the housing. The holes 356 of the top and bottom plates will be aligned to receive a padlock to hold the plates in their pulled-out positions. The inner ends of the elongated plates 352 and 353 are pivotally connected to one end of a bar 357 of channel-shaped cross section. The opposite end of the bar 357 is pivotally connected to the housing partition 337 at 359 to permit limited rotational movement of the bar 357 so that its end which is connected to the flat plates 352 and 353 can move in a limited arc towards and away from the front wall 275 of the housing as the flat plates 352 and 353 move in and out. The pivotal connection is in the form of hooks 358 formed on the end of the channel-shaped bar which fit into slots 360 formed in the partition 337. The end of the channel-shaped bar is also formed with a tab having an opening (not shown) which aligns with an opening 361 formed between the slots 360 in the partition 337. A spring biased pin 362 similar to pin 313 fits through the opening which is not shown in the channel bar end well and the opening 361 in the partition 337 to connect the partition to the channel-shaped bar. The channel-shaped bar 357 is notched at 364 to permit the bar to be moved under the head 253 of the stub arm pivot pin 249. Thus, when the flat plates 352 and 353 are pulled out, the engagement of the notch 362 of the bar 357 will prevent rotation of the stub arm 217 from its switch contacts open position shown in FIG. 3. A downwardly extending finger 363 of the bottom plate 353 engages a switch 365 supported in a bracket 367 below the bottom plate 353. Switch 365 is normally in a contacts closed state but engagement by the finger 365 when the plates 352 and 353 are moved to their lockout position will open the switch contacts. To prevent actuation of the lockout 351 when the shaft 53 has been rotated to its switch contacts on position shown in FIG. 1, a curved finger 371 shown in FIGS. 3, 4 and 5 is attached to the sleeve 257. The finger 371 rotates with the shaft 53 to block outward pivoting movement of the lockout bar 357.

A bracket 373 is attached to the lever 231 near its pivot 221. The bracket carries a finger 375 which engages a plunger of a limit switch 377 mounted on a bracket 379. When the switch contacts of the load break switch are in their open position, the contacts of the limit switch 377 are open due to engagement of finger 375 with the plunger of switch 377. When the finger 375 is rotated to its other position upon rotation of the lever 231 in a counter clockwise direction as viewed in FIG. 3, it will engage and depress a plunger of a limit switch 381 mounted on a bracket 383. The limit switch 381 has a set of normally open contacts 385 and a set of normally closed contacts 387. The contacts 385 are open when the load break switch contacts are in their open condition but are closed by movement of the lever 231 to the switch contacts closed position. When the close button 281 is depressed, the close contacts of switch 279 are closed and the solid state relay 287 is energized through the normally closed switch contacts 387. Energization of solid state relay 287 energizes solid state relays 289 and 295 to release the internal brake of the linear actuator and extend the tube 219 of the linear actuator. The normally closed contacts 387 are opened when lever 231 is rotated fully counterclockwise to its position shown in FIG. 11 by extension of the tube 219. Opening of the contacts 387 deenergizes solid state relay 389 to stop the extension of tube 219. The solid state relay 285 is then energized through closed switch contacts 377 which in turn energizes solid state relays 291 and 389 to release the internal brake of the linear actuator 211 and to retract the tube 219 to move it to the position shown in FIG. 12.

Figure 13:
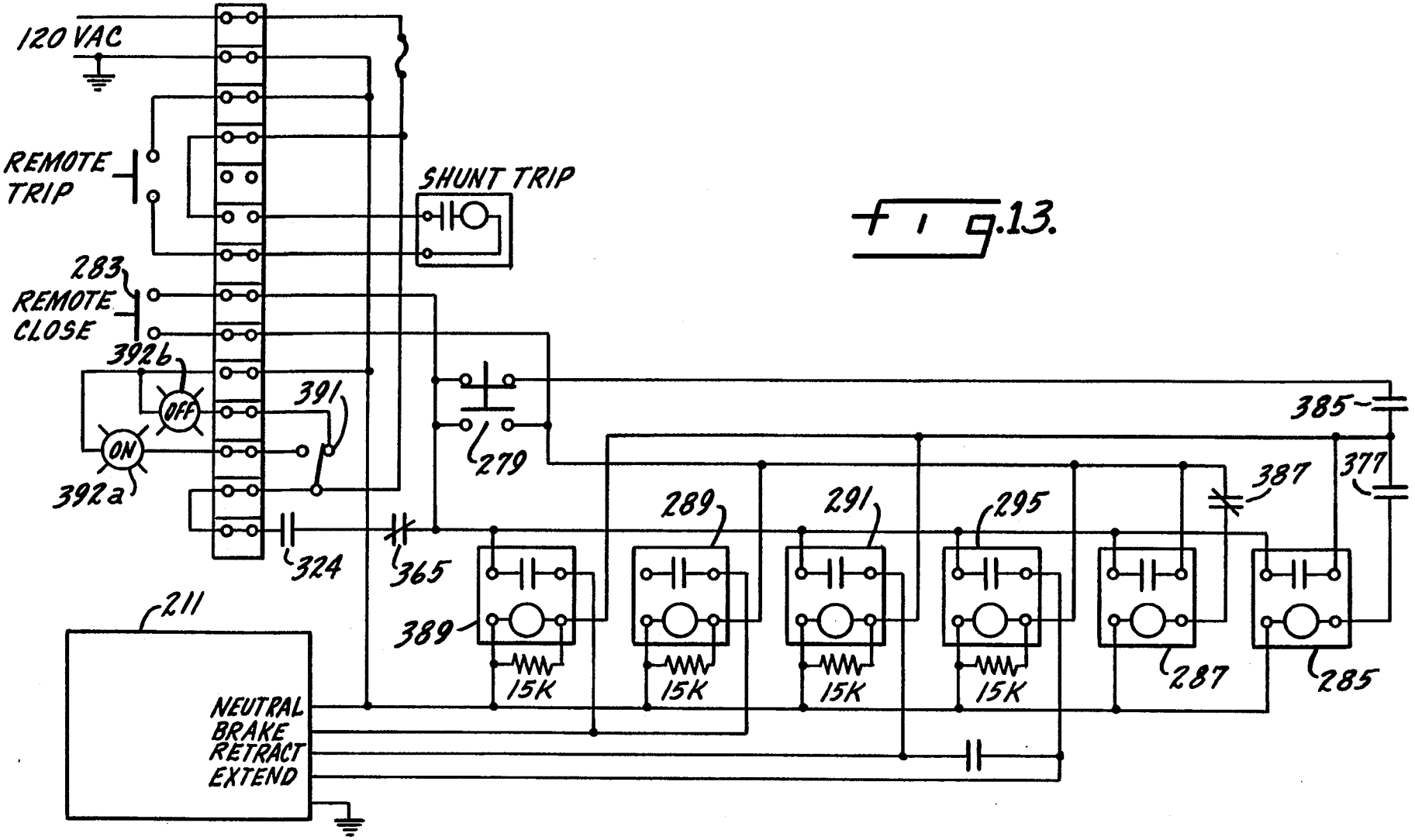
FIG. 13 is a schematic diagram of the electrical control circuits for the linear motor powered shunt trip operator mechanism of FIG. 1.

A switch 391 for "on-off" indicating lights **392*a* and 392*b* is shown in FIGS. 3, 4 and 13. The switch 391 is supported in a bracket 393 and has a plunger which contacts an edge 395 of the counterweight 267. When the switch contacts are open, as shown in FIG. 3, the plunger is in its retracted position and the "off" indicating light 392*b* is energized. When the shaft 53 is rotated to the position shown in FIGS. 11 and 12, the edge 395 of the counterweight 267 is rotated away in a counterclockwise direction and the plunger of the switch 391 is allowed to extend to its position in which the "on" indicating light 392*a*** is energized.

I claim:

1. A linear motor powered closing assembly for an operating mechanism of a high-current, low voltage load break switch having an operating shaft, a follower affixed to said operating shaft for rotation therewith, an operating lever mounted on said shaft for rotation relative thereto, and spring means connecting said follower and said operating lever to bias them toward each other when said spring means is charged, said closing assembly including:

a linear actuator having an extendible and retractable tube, a drive rod connected to said operating shaft to rotate said shaft in a spring means charging direction upon longitudinal movement of said drive rod in one direction, means connecting said actuator tube and said drive rod so that movement of said actuator tube in one direction will move said drive rod in its spring means charging direction while movement of said actuator tube in the opposite direction will not cause opposite movement of said drive rod.

2. The closing assembly of claim 1 in which said means connecting said actuator tube and said drive rod include a lever pivotally mounted at one end to a fixed location and pivotally connected at its opposite end to said actuator tube, and a one-way drive means operatively connected between said lever and said drive rod including a drive pin mounted on one of said lever and said drive rod and a drive pin guiding slot located in the other of said lever and said drive rod, said one-way drive means being located between the pivotal connections of said lever.

3. The closing assembly of claim 2 in which said drive pin is mounted on said lever and said drive pin guiding slot is located in said drive rod.

4. The closing assembly of claim 1 in which means are provided to prevent said operating shaft from rotating in said spring means charging direction when an access door is open, said last mentioned means including a push rod which engages and is moved by said door, a pivotally mounted member which is rotated upon movement of said push rod, a hook formed on said pivotally mounted member, and a hook engaging surface connected to said operating shaft.

5. The closing assembly of claim 1 in which means are provided to prevent said operating shaft from rotating in said spring means charging direction when work is underway on the assembly, said last mentioned means include an arm movable into and out of engagement with said drive rod when said drive rod is in its non-spring charging location, a first slidably mounted plate pivotally connected to said arm and slidably movable in a first direction to move said arm into engagement with said drive rod and a second direction to move said arm out of engagement with said drive rod, and means to secure said first slidably mounted plate in said first direction of movement.

6. The closing assembly of claim 5 further including a second slidably mounted plate also pivotally connected to said arm and movable simultaneously with said first plate, said means to secure said first slidably mounted plate also secures said second plate and includes a notch in one of said plates, means to engage said notch to prevent movement of said plate in said second direction when said plates are rotated relative to each other, and alignable openings in said plates to receive a padlock when said plates are rotated relative to each other.

* * * * *